US007389183B2

(12) United States Patent
Gray

(10) Patent No.: US 7,389,183 B2
(45) Date of Patent: Jun. 17, 2008

(54) METHOD FOR DETERMINING A STUCK POINT FOR PIPE, AND FREE POINT LOGGING TOOL

(75) Inventor: Kevin L. Gray, Friendswood, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 198 days.

(21) Appl. No.: 10/967,588

(22) Filed: Oct. 18, 2004

(65) Prior Publication Data

US 2005/0240351 A1 Oct. 27, 2005

Related U.S. Application Data

(63) Continuation-in-part of application No. 10/211,252, filed on Aug. 2, 2002, now Pat. No. 6,851,476.

(60) Provisional application No. 60/310,124, filed on Aug. 3, 2001.

(51) Int. Cl.
*G01V 1/40* (2006.01)
*E21B 47/00* (2006.01)
*E21B 47/09* (2006.01)

(52) U.S. Cl. ..... 702/6; 73/152.56; 166/255.1

(58) Field of Classification Search ..... 702/6, 702/9; 73/152.56, 862.331, 152.54; 166/255.1, 166/373; 175/41; 340/853.1, 854.1
See application file for complete search history.

(56) References Cited

U.S. PATENT DOCUMENTS 2,817,808 A * 12/1957 Gieske ..... 324/221
2,992,390 A * 7/1961 De Witte ..... 324/220
3,404,563 A 10/1968 Davis et al.
3,762,218 A * 10/1973 Davis ..... 73/152.56

(Continued)

FOREIGN PATENT DOCUMENTS

EP 0938621 9/1999

(Continued)

OTHER PUBLICATIONS

Underhill et al., Model-Based Sticking Risk Assessment for Wireline Formation Testing Tools in the U.S. Gulf Coast, 1998. SPE 48963, pp. 79-89.*

(Continued)

*Primary Examiner*—John E Barlow, Jr.
*Assistant Examiner*—Toan M Le
(74) *Attorney, Agent, or Firm*—Patterson & Sheridan, L.L.P.

(57) ABSTRACT

A method and apparatus for determining the location of stuck pipe are provided. In one embodiment, the method includes the step of attaching a free point logging tool to a working line such as a slickline or wireline. The free point logging tool has a freepoint sensor and, optionally, an acoustic sensor. The freepoint sensor acquires magnetic permeability data in a string of pipe, while the acoustic sensor acquires acoustic data in the pipe. Two sets of data for each sensor are acquired—one in which the pipe under investigation is unstressed, and one in which the pipe is stressed. The first set and second sets of magnetic permeability data are compared to determine the stuck point location for the pipe. The first and second sets of acoustic data are compared to determine the nature in which the pipe is stuck.

49 Claims, 3 Drawing Sheets

U.S. PATENT DOCUMENTS

| | | | | | |
|---|---|---|---|---|---|
| 4,033,413 | A | * | 7/1977 | Rogers | 166/301 |
| 4,051,456 | A | * | 9/1977 | Heilhecker et al. | 340/855.2 |
| 4,105,070 | A | * | 8/1978 | Lavigne et al. | 166/250.13 |
| 4,105,071 | A | * | 8/1978 | Nicolas et al. | 166/250.13 |
| 4,125,013 | A | | 11/1978 | Nicolas et al. | |
| 4,184,546 | A | | 1/1980 | Nicolas et al. | |
| 4,207,765 | A | * | 6/1980 | Kiff | 73/152.56 |
| 4,351,186 | A | * | 9/1982 | Moulin | 73/152.56 |
| 4,402,219 | A | * | 9/1983 | Hache | 73/152.56 |
| 4,444,050 | A | | 4/1984 | Revett | 73/152.56 |
| 4,465,139 | A | * | 8/1984 | Marquez et al. | 166/373 |
| 4,515,010 | A | | 5/1985 | Weido et al. | 73/152.56 |
| 4,708,204 | A | * | 11/1987 | Stroud | 166/255.1 |
| 4,766,764 | A | * | 8/1988 | Trevillion | 73/152.56 |
| 4,966,234 | A | * | 10/1990 | Whitten | 166/250.13 |
| 5,375,476 | A | * | 12/1994 | Gray | 73/862.331 |
| 5,448,911 | A | * | 9/1995 | Mason | 73/152.47 |
| 5,495,755 | A | * | 3/1996 | Moore | 73/152.02 |
| 5,508,915 | A | * | 4/1996 | Tsao et al. | 702/9 |
| 5,520,245 | A | * | 5/1996 | Estes | 166/66 |
| 5,555,220 | A | * | 9/1996 | Minto | 367/86 |
| 5,850,879 | A | * | 12/1998 | Smith | 166/250.01 |
| 5,984,009 | A | * | 11/1999 | DiFoggio | 166/250.13 |
| 6,009,948 | A | * | 1/2000 | Flanders et al. | 166/301 |
| 6,084,403 | A | * | 7/2000 | Sinclair et al. | 324/221 |
| 6,131,659 | A | * | 10/2000 | Johnson | 166/250.05 |
| 6,202,764 | B1 | * | 3/2001 | Ables et al. | 175/162 |
| 6,401,838 | B1 | * | 6/2002 | Rezmer-Cooper | 175/38 |
| 6,514,016 | B1 | * | 2/2003 | Williams et al. | 408/1 R |
| 6,536,519 | B1 | * | 3/2003 | Vaynshteyn et al. | 166/250.13 |
| 6,580,449 | B1 | * | 6/2003 | Meltzer | 348/85 |
| 6,581,453 | B1 | * | 6/2003 | Bjørnstad | 73/152.01 |
| 6,712,143 | B2 | * | 3/2004 | Robertson | 166/297 |
| 6,760,275 | B2 | * | 7/2004 | Carstensen | 367/83 |
| 6,945,330 | B2 | * | 9/2005 | Wilson et al. | 166/373 |
| 7,104,331 | B2 | * | 9/2006 | Bussear et al. | 166/373 |
| 7,187,620 | B2 | * | 3/2007 | Nutt et al. | 367/25 |
| 7,224,289 | B2 | * | 5/2007 | Bausov et al. | 340/854.8 |

FOREIGN PATENT DOCUMENTS

| | | |
|---|---|---|
| GB | 2158245 | 11/1985 |
| GB | 2 353 055 | 2/2001 |
| WO | WO98/21445 | 5/1998 |

OTHER PUBLICATIONS

Jardine et al., An Advanced System for the Early Detection of Sticking Pipe, 1992, SPE 23915, pp. 659-667.*

Santos, H., Differential Stuck Pipe: Early Diagnostic and Solution, 2000, SPE 59127.*

Wisian et al., Field Comparison of Conventional and New Technology Temperature Logging Systems, 1998, Geothermics vol. 27, No. 2, pp. 131-141.*

EP Search Report, Application No. EP05109498, dated Jan. 16, 2006.

Canadian Office Action, Application No. 2,522,505, dated Jun. 26, 2007.

EP Office Action, Application No. 05 109 498.5-2315, dated Nov. 7, 2007.

* cited by examiner

METHOD FOR DETERMINING A STUCK POINT FOR PIPE, AND FREE POINT LOGGING TOOL

CROSS REFERENCE TO RELATED APPLICATIONS

This application is a continuation-in-part of U.S. patent application Ser. No. 10/211,252 filed Aug. 2, 2002 now U.S. Pat. No. 6,851,476, which claims benefit of U.S. Provisional Patent Application Ser. No. 60/310,124, filed Aug. 3, 2001.

BACKGROUND OF THE INVENTION

1. Field of the Invention

The present invention relates to an apparatus and method for use in a wellbore. In addition, the invention relates to a downhole tool for determining the location and nature of an obstruction in a wellbore. More particularly still, the invention relates to a downhole tool for locating the point at which a tubular such as a drill string is stuck in a hollow tubular or a wellbore.

2. Description of the Related Art

Wellbores are typically formed by boring a hole into the earth through use of a drill bit disposed at the end of a tubular string. Most commonly, the tubular string is a series of threadedly connected drill collars. Weight is applied to the drill string while the drill bit is rotated. Fluids are then circulated through a bore within the drill string, through the drill bit, and then back up the annular region formed between the drill string and the surrounding earth formation. The circulation of fluid in this manner serves to clear the bottom of the hole of cuttings, serves to cool the bit, and also serves to circulate the cuttings back up to the surface for retrieval and inspection.

With today's wells, it is not unusual for a wellbore to be completed in excess of ten thousand feet. The upper portion of the wellbore is lined with a string of surface casing, while intermediate portions of the wellbore are lined with liner strings. The lowest portion of the wellbore remains open to the surrounding earth during drilling. As the well is drilled to new depths, the drill string becomes increasingly longer. Because the wells are often non-vertical or diverted, a somewhat tortured path can be formed leading to the bottom of the wellbore where new drilling takes place. Because of the non-linear path through the wellbore, the drill string can become bound or other wise stuck in the wellbore as it moves axially or rotationally. In addition, the process of circulating fluids up the annulus within the earth formation can cause subterranean rock to cave into the bore and encase the drill string. All drilling operations must be stopped and valuable rig time lost while the pipe is retrieved.

Because of the length of the drill string and the difficulty in releasing stuck pipe, it is useful to know the point at which one tubular is stuck within another tubular or within a wellbore. The point above the stuck point is known as the "free point." It is possible to estimate the free point from the surface. This is based upon the principle that the length of the tubular will increase linearly when a tensile force within a given range is applied. The total length of tubular in the wellbore is known to the operator. In addition, various mechanical properties of the pipe, such as yield strength and thickness, are also known. The operator can then calculate a theoretical extent of pipe elongation when a certain amount of tensile force is applied. The theoretical length is based on the assumption that the applied force is acting on the entire length of the tubular.

The known tensile force is next applied to the tubular. The actual length of elongation of the pipe is then measured at the surface of the well. The actual length of elongation is compared with the total theoretical length of elongation. By comparing the measured elongation to the theoretical elongation, the operator can estimate the sticking point of the tubular. For example, if the measured elongation is fifty percent of the theoretical elongation, then it is estimated that the tubular is stuck at a point that is approximately one half of the length of the tubular from the surface. Such knowledge makes it possible to locate tools or other items above, adjacent, or below the point at which the tubular is expected to be stuck.

It is desirable for the operator to obtain a more precise determination of the stuck point for a string of pipe. To do this, the operator may employ a tool known as a "free point tool." The prior art includes a variety of free point apparatuses and methods for ascertaining the point at which a tubular is stuck.

One common technique involves the use of a tool that has either one or two anchors for attaching to the inner wall of the drill pipe. The tool is lowered down the bore of the drilling pipe, and attached at a point to the pipe. The tool utilizes a pair of relatively movable sensor members to determine if relative movement occurred. The tool is located within the tubular at a point where the stuck point is estimated. The tool is then anchored to the tubular at each end of the free point tool, and a known tensile force (or torsional force) is applied within the string. Typically, the force is applied from the surface. If the portion of the pipe between the anchored ends of the free point tool is elongated when a tensile force is applied (or twisted when a torsional force is applied), it is known that at least a portion of the free point tool is above the sticking point. If the free point tool does not record any elongation when a tensile force is applied (or twisting when a torsional force is applied), it is known that the free point tool is completely below the sticking point. The free point tool may be incrementally relocated within the drill pipe, and the one or more anchor members reattached to the drill pipe. By anchoring the free point tool within the stuck tubular and measuring the response in different locations to a force applied at the surface, the location of the sticking point may be accurately determined.

Mechanical free point tools of this type are considered reliable; however, they suffer from certain disadvantages. For example, mechanical transducer free point tools rely upon moving parts. It is desirable to have a free point tool that contains few or no moving parts. In addition, mechanical free point tools are considered slow to operate. In this respect, the sequential attachment and detachment of the free point tool to the drill string requires time. Those familiar with the drilling industry understand that the operation of a drilling rig, particularly those located offshore, is very expensive.

Other tools have been developed which include means for measuring the magnetic permeability of the pipe. In this regard, one known characteristic of ferromagnetic pipe is that the magnetic permeability of the material changes as a function of stresses in the material. This principle allows for the detection of changes in magnetic flux rather than mechanical movement. The operator maintains constant tension in the stuck pipe from the surface, and allows the magnetic permeability tool sensor to operate while the tool is being moved through a selected section of drill pipe. The operator maintains data that correlates changes in magnetic flux to depth of the tool. This may prove to be a faster procedure than free point tools that rely upon sequential mechanical anchoring to the drill string. However, the operation of such a tool remains expensive, as it requires that an electrical wireline be provided for running into the wellbore.

A need therefore exists for a free point tool that can be quickly run into a wellbore on a more economical basis. A need alternatively exists for a free point logging tool that employs digital telemetry memory technology to store detected information downhole for quick retrieval and subsequent analysis. Still further, a need exists for a free point tool that combines features of an acoustic stuck pipe logging tool (which graphically presents information as to the stuck condition of a pipe), with a free point sensor in one logging string package.

SUMMARY OF THE INVENTION

The present invention generally provides a method for determining the location of stuck pipe. More specifically, a method is provided for determining a stuck pipe point in a wellbore. In addition, a free point logging tool is provided.

In one embodiment, the method includes the step of attaching a free point logging tool to a slickline. The free point logging tool has a freepoint sensor and a power module such as a battery stack for providing power to the freepoint sensor. The method also includes the steps of actuating the sensor, moving the slickline and connected free point logging tool through a selected portion of the wellbore a first time to obtain a first set of magnetic permeability data as a function of wellbore depth, applying stress to the pipe, moving the slickline and connected free point logging tool through the selected portion of the wellbore a second time to obtain a second set of magnetic permeability data, and comparing the first set of magnetic permeability data to the second set of magnetic permeability data to determine the stuck point for the pipe. Preferably, the steps of moving the slickline and connected free point logging tool through a selected portion of the wellbore a first time and a second time each comprise lowering the free point logging tool to a selected depth within the wellbore, and then pulling the free point logging tool towards the surface.

In one embodiment, the free point logging tool includes an acoustic sensor. The acoustic sensor is used to acquire acoustic data during the first and second passes. The first and second sets of acoustic data can be compared in order to determine the nature in which the pipe is stuck at the stuck point. Other logging tools may also be implemented, including pressure and temperature sensors.

In one embodiment, the free point logging tool further has a memory module for receiving and recording the first set and the second set of data, respectively, from the freepoint sensor. In this arrangement, the step of comparing the first set of magnetic permeability data to the second set of magnetic permeability data includes retrieving the first and second sets of data from the memory module at the surface, and then analyzing the first and second sets of data. In another embodiment, the free point logging tool further has a telemetry module for receiving the first set and the second set of data, respectively, from the freepoint sensor. In this arrangement, the step of comparing the first set of magnetic permeability data to the second set of magnetic permeability data includes transmitting the first set of data from the telemetry module downhole to a receiver at the earth surface, transmitting the second set of data from the telemetry module downhole to the receiver at the earth surface, and analyzing the first and second sets of data.

In one arrangement, the free point logging tool further includes a transmitter coil, and a receiver coil. The transmitter coil and the receiver coil may be separate coils, or may be a unitary coil serving alternating functions of transmitting and receiving magnetic energy. In another arrangement, the free point logging tool further includes an acoustic stuck pipe logging tool.

In an alternate embodiment, the method for determining the location of stuck pipe is accomplished via a single pass by slickline. In such a method, a free point logging tool is again attached to a slickline. The free point logging tool again has a freepoint sensor and a power module such as a battery stack for providing power to the freepoint sensor. The method includes the steps of applying a stress to the pipe, actuating the sensor, moving the slickline and connected free point logging tool through a selected portion of the wellbore to obtain magnetic permeability data as a function of wellbore depth and time, and comparing the acquired magnetic permeability data to a set of magnetic permeability data already known to determine the stuck point for the pipe.

A free point logging tool is also provided. The free point logging tool has a cable head, and is configured to be run into a wellbore on a slickline. In an alternate aspect, the cable head is configured to connect to an electric wireline. In this arrangement, the free point logging tool may have a wireline interface, a telemetry module, and a freepoint sensor.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

FIG. 3 shows a cross-sectional view if a wellbore, with a free point logging tool being moved there through.

DETAILED DESCRIPTION

Figure 1:
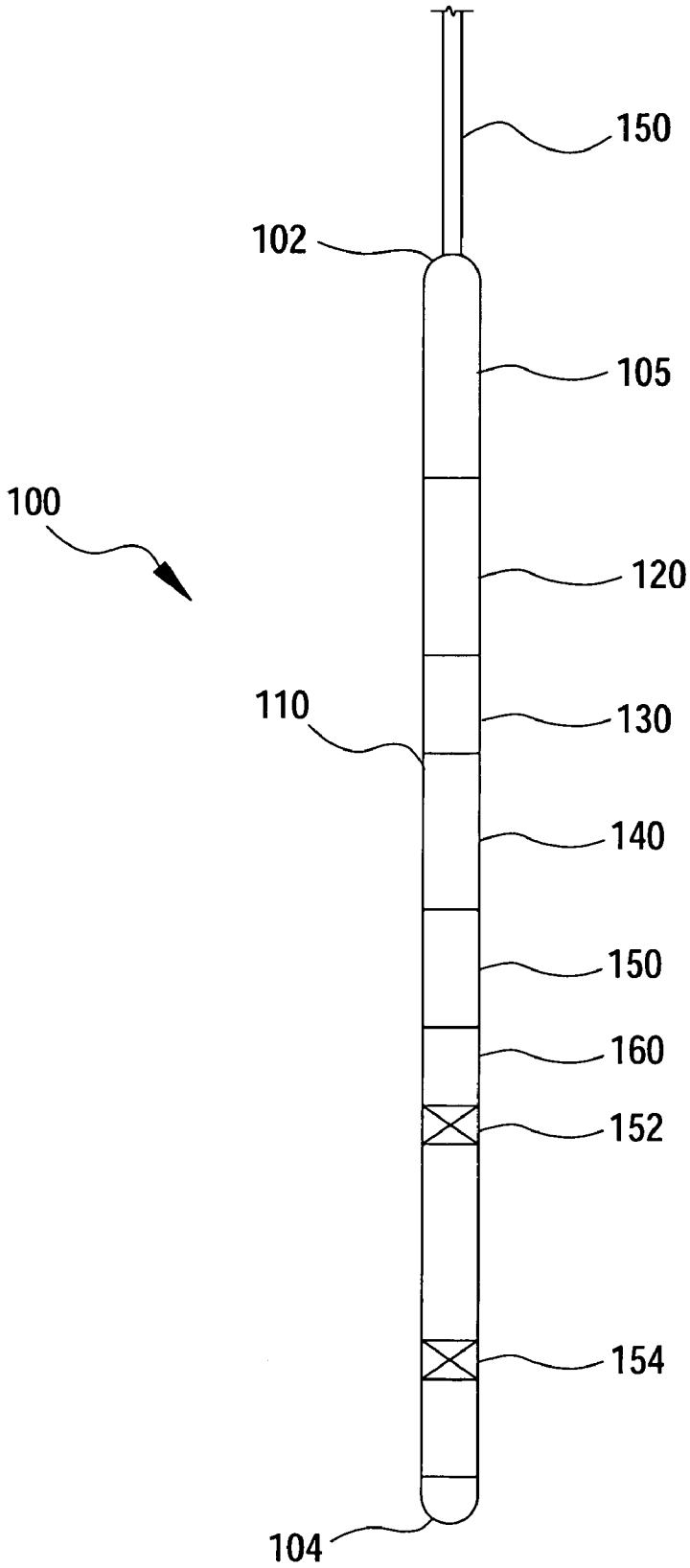
FIG. 1 provides a schematic side view of a free point logging tool, in one embodiment. This embodiment is configured to be run into a wellbore on a slickline.

FIG. 1 provides a schematic side view of a free point logging tool 100, in one embodiment. This embodiment is configured to be run into a wellbore (such as wellbore 50 of FIG. 3) on a slickline. A slickline is shown in FIG. 1 at 150. For purposes of this disclosure, the term "slickline" also includes a sand line. The slickline provides mechanical connection between the tool 100 in the wellbore and a spool (such as spool 155 in FIG. 3) at the surface, but does not provide an electrical connection.

Other forms of mechanical connection between the tool 100 and a surface dispenser may also be employed. Such examples include tubing, coiled tubing and continuous sucker rods. For purposes of the disclosure herein, the line of FIG. 1 will be referred to as a slickline. Slickline is preferred due to its lower cost and efficiency.

The logging tool 100 includes a cable head 105 at an upper end 102 of the tool 100 for attaching to the slickline 150 during logging operations. In this manner, the logging tool 100 is run into the wellbore gravitationally, and then pulled back to the surface by applying tension to the line 150. Gravitational pull on the tool may be aided by the injection of fluids from the surface in order to "push" the slickline and connected logging tool 100 downward.

A housing 110 is preferably provided for the logging tool 100. The housing 110 serves to house and protect a series of "modules" that make up the tool 100. In one aspect, the housing 110 is an integral tubular housing. In another aspect, the housing 110 is the outer surface of the various modules, placed in series. In this nomenclature, the cable head 105 may be considered as the first "module."

The next module is a power module 120. An example of a power module is a battery stack. As the name implies, the battery stack 120 consists of one or more batteries, and is used to supply power to the logging tool 100 during slickline applications. Preferably, the battery stack 120 represents a two or more batteries stacked in series. An example of a suitable battery includes an Electrochem 3B3900 MWD150DD battery cell.

The logging tool 100 also includes a freepoint sensor 150. The freepoint sensor 150 employs an inductive sensing means to detect changes in pipe magnetic permeability. Those of ordinary skill in the art will understand that ferrous pipe will change its magnetic permeability when stressed (or strained). The freepoint sensor 150 can be one or many inductive coils to detect pipe permeability. Alternatively, the freepoint sensor 150 can be one or many lenses or pickups. In the simplest method, the inductive sensor can be a single coil design that magnetically couples to the pipe under investigation. The coil would be part of an oscillating circuit, and its output frequency would change in relationship to pipe permeability. A second sensor arrangement employs two coils, representing a transmitter (or "exciter") coil and a receiver coil. In the tool 100 of FIG. 1, part 152 represents a transmitter coil, while part 154 represents a receiver coil. The transmitter coil 152 generates circulating currents within the pipe under investigation. The receiver coil 154, in turn, detects phase shifts in the transmitter coil 152 output. The phase shifts are linearly related to pipe permeability.

It is understood that other types of non-contact means of measuring pipe permeability exist, although most can be generally classified into one of the above two methods. A variety of non-contact or contact electromagnetic means that detects changes in permeability can be employed as a freepoint measuring device, and the claims of the present invention are not limited by the type of freepoint sensor employed.

The free point logging tool 100 optionally includes an acoustic stuck pipe module 160. The acoustic stuck pipe module 160 represents a separate module within the free point logging tool 100. The acoustic stuck pipe module 160 is preferably a single transmit/receive crystal pair. Acoustic energy is generated within the pipe by the transmitter (not shown). The single receiver (not shown) receives the acoustic energy as a return pulse, and converts the sonic wave energy to an electrical signal. Thus, the receiver acts as a transducer. A corresponding value of the electrical signal, such as amplitude of the acoustic echo return pulse yields information about what is behind the pipe. If the pipe is stuck the return pulse amplitude will be high; conversely, if the pipe is free, the return acoustic pulse amplitude will be lower. Such a stuck pipe logging tool, or "SPL," operates essentially in reverse of a Cement Bond Logging tool, or "CBL." Where a bond is detected, that is most likely a region where the pipe is stuck.

Other acoustic type SPL tools may be used with the free point logging tool 100. One example is an acoustic logging tool that employs two receiver coils (not shown). In one arrangement, the receiver coils are spaced 3 ft and 5 ft away, respectively from a transmit crystal (not shown). Again, as in the single transmit/receive coil, signal amplitude is primarily looked at to determine if the pipe is stuck at a particular location. In the area where the pipe is stuck, a high return amplitude is detected; in areas where the pipe is free, the return amplitude is low.

Of note, the use of a two-receiver acoustic transducer allows for measurement of travel time. In this respect, travel time, or wave speed, can be used as a freepoint measurement. A technique can be employed that indicates pipe stress through the acoustoelastic principle where small variations in strain can affect the wave speed. By recording the wave speed, or the travel time between spaced receiver transducers, the change in pipe stress can be calculated. Stress and strain are related, meaning that one can determine the other when one is known.

The next module in the logging tool 100 is a memory module 130. The memory module 130 is responsible for controlling operation of the logging tool 100 as well as storing data retrieved from the freepoint 150 and acoustic 160 sensors (and other bus connected components). The freepoint 150 and acoustic 160 sensor modules communicate with the memory module 130 via a field bus connection between bus connected modules. In one aspect, an HDLC protocol is employed for data communication. In lieu of a memory module, or in addition, the module 130 may represent a telemetry module. In this embodiment, the module 130 transmits data received from the freepoint 150 and acoustic 160 sensors, or other bus connected modules to an operating station at the surface. Such telemetry devices may include a QPSK data communication scheme for transmission of data to the surface, and a frequency shift key (FSK) data communication method for receiving control signals from the surface.

The free point logging tool 100 has a lower end 104. The lower end is preferably rounded to aid as a guide to entry through the wellbore. Centralizers (not shown) would preferably be attached to the bottom of the line 150 and, optionally to the bottom 104 of the tool 100.

Figure 2:
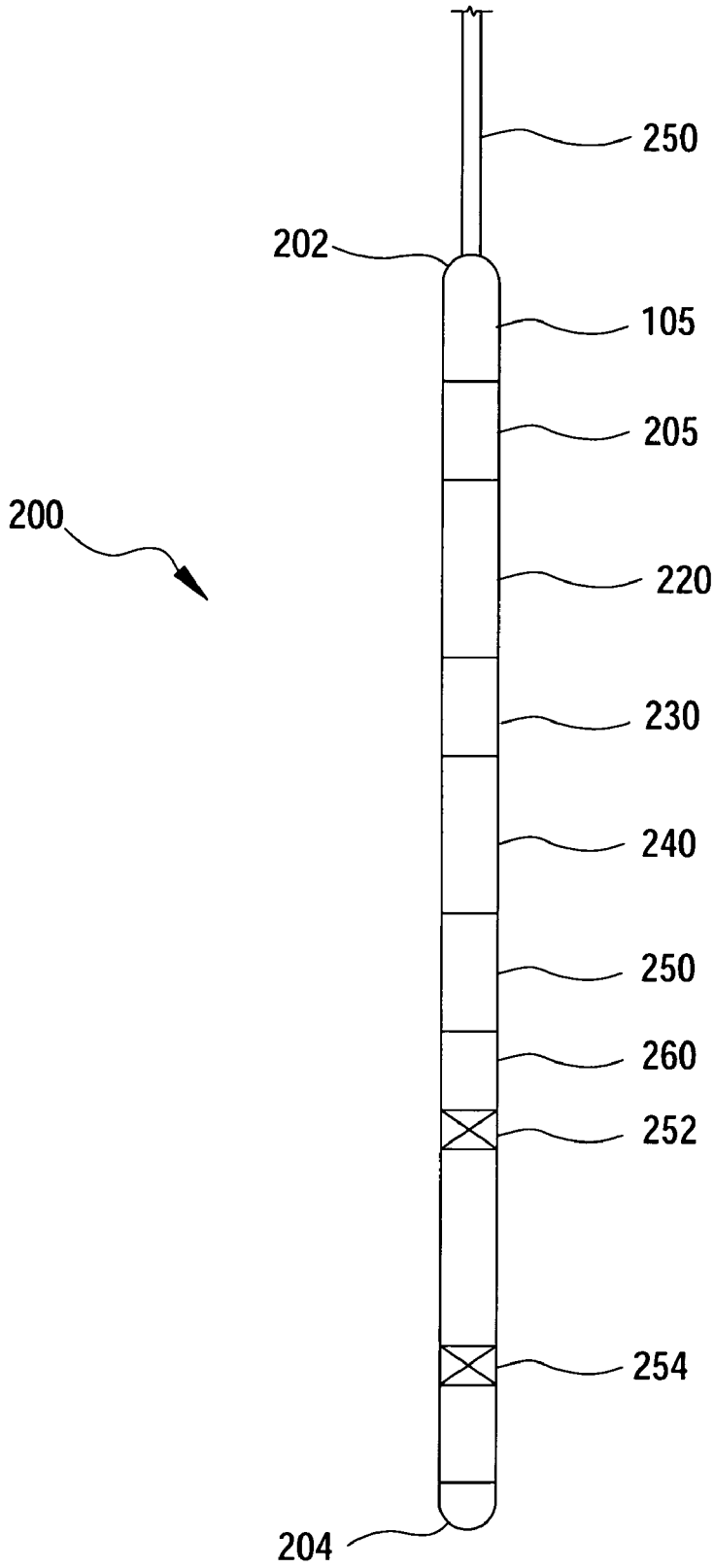
FIG. 2 presents a schematic side view of a free point logging tool, in an alternate embodiment. This embodiment is configured to be run into a wellbore on an electric wireline.

FIG. 2 presents a schematic side view of a free point logging tool 200, in an alternate embodiment. This embodiment is configured to be run into a wellbore on an electric wireline. An electric line is shown at 250 in FIG. 2.

The wireline 250 may be a conventional electric line that consists of an armored coaxial conductor cable for providing both a mechanical and electrical connection between the tool 200 and the electric line 250. The electric line 250 provides electrical communication with control and monitoring equipment located at the surface (not shown in FIG. 2). The wireline 250 preferably comprises one or more electrically conductive wires surrounded by an insulative jacket. As with the tool 100 of FIG. 1, mechanical connection of the tool 100 with the line 250 is by means of a cable head 105 at an upper end 202 of the tool 200.

In the arrangement of FIG. 2, a wireline interface 205 is provided. The wireline interface 205 is unique to electric line (or "e-line") applications, and is not required for slickline applications. The wireline interface 205 enables electrical communication between the electric line 250 and electronics within the tool 200, described below. The wireline interface 205 is preferably a module that is used to segregate power from the electric line 250 while imparting QPSK telemetry data back up through the electric line 250 to an interface at the surface. Preferably, the interface 205 will also downlink FSK data from the surface for control of any bus connected tool module.

As with the logging tool 100 of FIG. 1, the logging tool 200 of FIG. 2 may include an elongated tubular housing 210. This housing 210, again, protects the various parts that make up the logging apparatus 200.

The next module is a power module such as a battery stack 220. The battery stack 220 again consists of one or more batteries. For e-line operations, the battery stack 220 is used to provide backup power to the logging tool 200. Preferably, the battery stack 220 represents two or more batteries stacked in series.

As with the free point logging tool 100 of FIG. 1, the logging tool 200 of FIG. 2 will also include a freepoint sensor 250. In addition, an acoustic sensor 260 may optionally be employed. The freepoint sensor 250 and the acoustic sensor 260 will be as described above for logging tool 100.

The next module is again a memory module 230. As noted above, the memory module 230 is responsible for controlling operation of the logging tool 200 as well as storing data retrieved from the freepoint 250 and acoustic 260 sensors (and other bus connected components). For electric line applications, the memory module 230 also shuttles freepoint and acoustic information to surface instrumentation via the wireline interface 205 and on to the line 250.

The free point logging tool 200 has a lower end 204. The lower end 204 is preferably rounded to aid as a guide to entry through the wellbore.

The logging tools 100, 200 preferably utilize both acoustic and magnetic means to develop a free point log. Alternatively, the logging tools 100, 200 may utilize optic or electric means to develop the free point log. One feature of the tool utilizes the fact that magnetic permeability of the pipe changes with strain. As such, a change in magnetic permeability with the pipe under strain indicates the "stuck point" of a pipe. The other feature of the tool would utilize acoustics to compare the "bond" between the pipe and the formation. Where the formation is collapsed against the pipe, the log would reflect that condition in the first response of the acoustic signal and verify the "stuck point." A log is generated that can be interpreted at the surface before conducting any further pipe recovery operations. Once the location and nature of the stuck point is identified, a string shot or some other means of cutting or backing off the pipe may be conducted.

Figure 3:
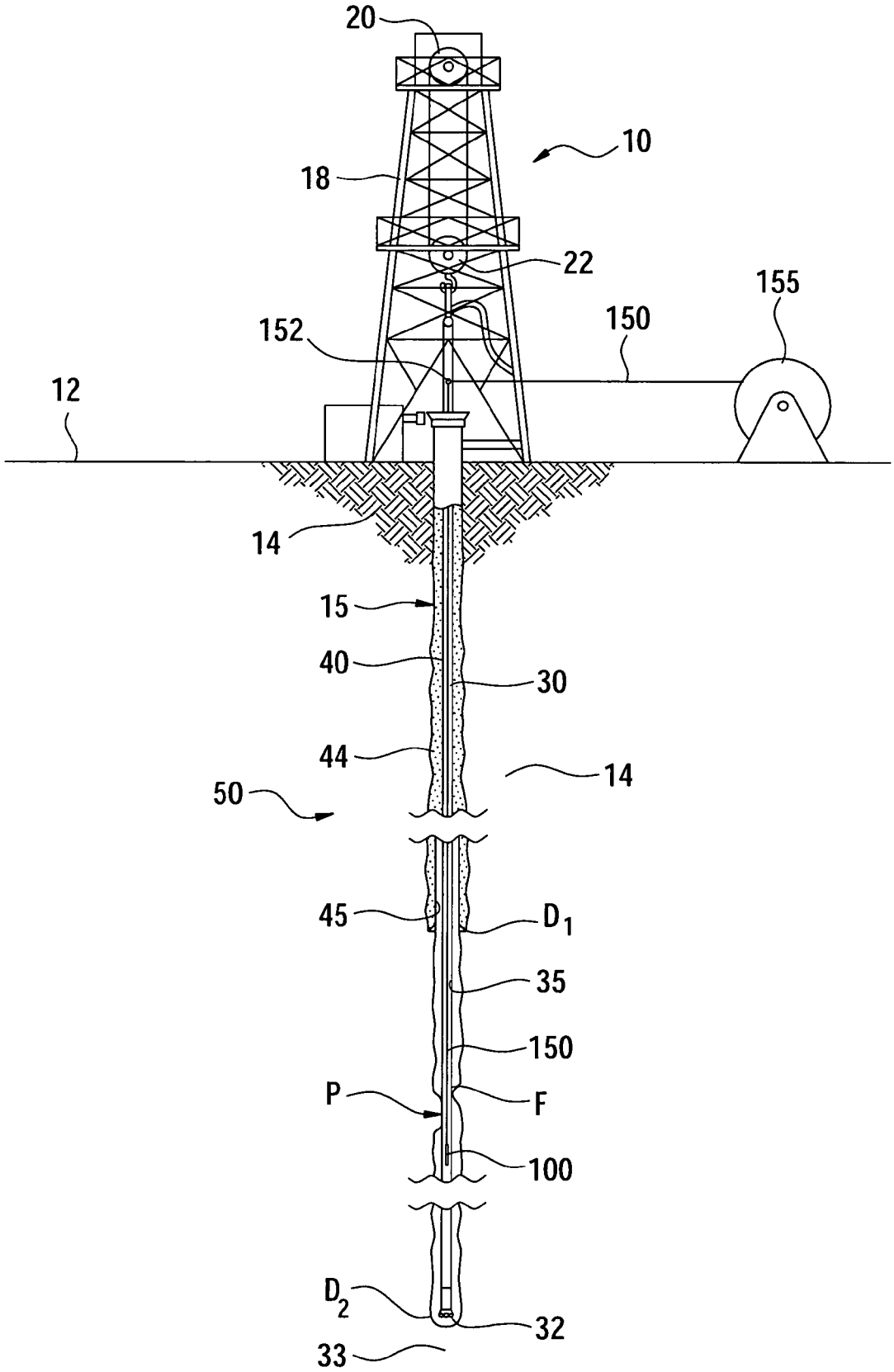

FIG. 3 shows a cross-sectional view of a wellbore 50 being formed. A drilling rig 10 is disposed over an earth surface 12 to create a bore 15 into subterranean formations 14. While a land-based rig 10 is shown in FIG. 3, it is understood that the methods and apparatus of the present invention have utility for offshore drilling operations as well.

The drilling rig 10 includes draw works having a crown block 20 mounted in an upper end of a derrick 18. The draw works also include a traveling block 22. The traveling block 22 is selectively connected to the upper end of a drill string 30. The drill string 30 consists of a plurality of joints or sections of drilling pipe which are threaded end to end. Additional joints of pipe are attached to the drill string 30 as the bore is drilled to greater depths.

The drill string 30 includes an inner bore 35 that receives circulated drilling fluid during drilling operations. The drill string has a drill bit 32 attached to the lower end. Weight is placed on the drill bit 32 through the drill string 30 so that the drill bit 32 may act against lower rock formations 33. At the same time, the drill string 30 is rotated within the borehole 15. During the drilling process, drilling fluid, e.g., "mud," is pumped into the bore 35 of the drill string 30. The mud flows through apertures in the drill bit 32 where it serves to cool and lubricate the drill bit, and carry formation cuttings produced during the drilling operation. The mud travels back up an annular region 45 around the drill string 30, and carries the suspended cuttings back to the surface 12.

It can be seen that the wellbore 50 of FIG. 3 has been drilled to a first depth $D_1$, and then to a second depth $D_2$. At the first depth $D_1$, a string of casing 40 has been placed in the wellbore 50. The casing 40 serves to maintain the integrity of the formed bore 15, and isolates the bore 15 from any ground water or other fluids that may in the formations 14 surrounding the upper bore 15. The casing 40 extends to the surface 12, and is fixed in place by a column of set cement 44. Below the first depth $D_1$, no casing or "liner" has yet been set.

It can be seen from FIG. 3 that a cave-in of the walls of the borehole 14 has occurred. The cave-in is seen at a point "P." The cave-in P has produced a circumstance where the drill string 30 can no longer be rotated or axially translated within the borehole 14, and is otherwise "stuck." It should be understood, however, that point "P" may be any downhole condition such as a predetermined location for measurement of tubular thickness or defect such as a hole or a crack, without departing from principles of the present invention.

As discussed above, it is desirable for the operator to be able to locate the depth of point P. To this end, and in accordance with the methods of the present invention, a free point logging tool such as tool 100 of FIG. 1 or tool 200 of FIG. 2 is run into the wellbore 50. In FIG. 3, the tool is shown as tool 100.

The free point logging tool 100 is run into the wellbore 50 on a line 150. The line 150 may be an electric wireline, a slickline or a coiled tubing string. In the arrangement of FIG. 3, the line 150 represents a slickline. The tool 100 then operates to locate the point P along the length of the drill string 30 at a measured distance from the surface 12 so that all of the free sections of drill pipe 30 above the stuck point P can be removed. Once all of the joints of pipe above an assured free point "F" are removed, new equipment can be run into the bore 15 on a working string to "unstick" the remaining drill string. From there, drilling operations can be resumed.

The free point logging tool 100 and slickline 150 are lowered into the wellbore by unspooling the line from a spool 155. The spool 155 is brought to the drilling location by a service truck (not shown). Unspooling of the line 150 into the wellbore 50 is aided by sheave wheels 152. At the same time, the traveling block 22 is used to suspend the drill string 30. In this respect, the pipe under investigation 30 is relaxed (no stress) for the first logging pass.

The slickline 150 and connected free point logging tool 100 are moved through a selected portion of the wellbore 50. The selected portion includes the estimated depth at which the stuck point P is believed to exist. By moving the logging tool 100 through the wellbore 50, a first set of magnetic permeability data is gathered, with the magnetic permeability data being measured as a function of wellbore depth and time.

As the logging string 150 is raised, the logging tool 100 records data locally. In the context of electric line applications (see logging tool 200 of FIG. 2), the logging tool 200 will shuttle information to surface instrumentation in real-time. Collected data would minimally include a measure of the pipe permeability. In addition, data may include amplitude of a return echo pulse and the travel time of the acoustic pulse. This information could be combined with other type of logging data such as temperature, pressure and orientation data where suitable modules are included in the logging string. Tools 100 and 200 include modules 140 and 240, respectively, for housing such additional logging sensors implemented with field bus technology. These logging sensors may include any number of sensors commonly used in logging tools, such as gamma ray tools, caliper tools and metal thickness tools.

The first log pass is made to establish a datum record of the condition of the pipe 30 with no stress applied. The logging operation may include the execution of more than one pass through the pipe section of interest to obtain a suitable base line of datum. This is the same for slickline or e-line applications. Alternatively, and where wellbore hardware data already exists, this first pass could be optionally eliminated.

After a suitable first set of data is acquired, the operator applies stress to the pipe 30 under investigation. Stress may be in the form of a torsional stress (by rotating), or tensile force (by pulling). While maintaining stress, the operator then again moves the free point logging tool 100 through the wellbore 50. Movement of the tool 100 through the wellbore 50 the second time should follow the same path as the first time. Preferably, the path would be to start below the assured stuck point P, and move towards the surface to a point well above the estimated free point F. While moving the slickline 150 and connected free point logging tool 100 through the selected portion of the wellbore 50 a second time, a second set of magnetic permeability data is obtained. In this respect, magnetic permeability data and, preferably, acoustic data, is recorded locally. In the context of electric line applications the logging tool 200 will again shuttle information to surface instrumentation in real-time.

After each set of data is obtained, the two sets of data are compared. Stated another way, data showing magnetic permeability, amplitude and travel time through the selected portion of drill string 30 under stress is compared to data showing magnetic permeability, amplitude and travel time through the selected portion of drill string 30 substantially without stress. In regions where the pipe 30 is free, there will be a departure in the permeability and travel time curves. In regions where the pipe 30 is stuck, there will be no departures in the permeability or travel time curves between each logging run, i.e., the first and second sets of data. Additionally, the amplitude of the return echo pulse within the free point (or stuck point) region using the acoustic sensor 160 or 260 will yield some information as to how and why the pipe is stuck at the location.

As noted above, tools 100 and 200 include modules 140 and 240, respectively, for housing additional logging sensors implemented with field bus technology. Thus, another logging operation may be performed simultaneously as tools 100 and 200 obtain data during the first log pass and the second log pass. In other words, one trip in the wellbore 50 could obtain data regarding the point P and other logging operation data by employing sensors similar to those found other logging tools such as gamma ray tools, caliper tools and metal thickness tools.

As further noted above, in the slickline embodiment of the free point logging tool 100, the tool 100 includes a memory module for receiving and recording the first and the second sets of data, respectively. Data is again received from the freepoint sensor. In this embodiment, the step of comparing the first set of magnetic permeability data to the second set of magnetic permeability data is accomplished by retrieving the first and second sets of data from the memory module at the earth surface. The first and second sets of data can then be downloaded into an appropriate computer and analyzed.

As also noted above, in one embodiment of the free point logging tool 100, the tool 100 includes a telemetry module for receiving the first and second sets of data, respectively. Data is again received from the freepoint sensor. In this embodiment, the step of comparing the first set of magnetic permeability data to the second set of magnetic permeability data is accomplished by transmitting the first set of data from the telemetry module downhole to a receiver at the earth surface, transmitting the second set of data from the telemetry module downhole to the receiver at the earth surface, and then analyzing the first and second sets of data.

In either embodiment, the free point logging tool 100 or 200 may include an acoustic stuck pipe logging tool. The acoustic logging tool informs the operator as to the manner in which the drill pipe 30 is stuck at point P. It is preferred that a collar counting locator device, or "CCL," also be run in concert with the tool 100. The CCL (not shown) would interface with the memory module 130 via the a data tool bus structure.

While the foregoing is directed to embodiments of the present invention, other and further embodiments of the invention may be devised without departing from the basic scope thereof, and the scope thereof is determined by the claims that follow.

What is claimed is:

1. A method for detecting a condition of an oil field tubular, comprising:

conveying a detection tool along an interior of the tubular on a slickline;

transmitting a waveform from the detection tool to a wall of the tubular, the waveform interacting with the wall;

receiving an interacted waveform from the wall of the tubular; and communicating the condition of the tubular based upon the received interacted waveform to a user, wherein the condition is a stuck point or a free point.

2. The method of claim 1, further including communicating data regarding the condition to a surface of a wellbore.

3. The method of claim 1, further including communicating data regarding the condition to a memory module in the detection tool.

4. The method of claim 1, further including communicating data regarding the condition through a telemetry module in the detection tool to a receiver proximate a surface of a wellbore.

5. The method of claim 1, wherein the detection tool includes a transmitter for transmitting the waveform and a receiver for receiving the interacted waveform.

6. The method of claim 1, wherein a wireline conveys the detection tool along the interior of the tubular.

7. The method of claim 1, wherein a coil tubing conveys the detection tool along the interior of the tubular.

8. The method of claim 1, wherein the oilfield tubular is a drill pipe.

9. The method of claim 1, wherein the oilfield tubular is a tubing.

10. The method of claim 1, wherein the oilfield tubular is a casing.

11. The method of claim 1, wherein the oilfield tubular is a pipeline.

12. The method of claim 1, further including storing data representative of a portion of the interacted waveform.

13. The method of claim 1, wherein the waveform is an electromagnetic waveform.

14. The method of claim 1, further comprising using the detection tool for receiving the interacted waveform.

15. The method of claim 1, wherein the waveform is an acoustic waveform.

16. The method of claim 1, wherein the waveform is a magnetic waveform.

17. The method of claim 1, wherein the waveform is an electric waveform.

18. An apparatus for detecting a condition of an oilfield tubular, comprising a detection tool having a body;

a waveform generating transmission portion;

a waveform receiving portion; and a user interface for communicating detection of the condition to the user, wherein the condition is a stuck point of the oil field tubular.

19. The apparatus of claim 18, wherein at least one of the waveform generating transmission portion and the waveform receiving portion is a pickup or lens.

20. The apparatus of claim 18, further including a cable head capable of connecting to a conveyance member.

21. The apparatus of claim 20, wherein the conveyance member is a slickline.

22. The apparatus of claim 21, further including a memory module coupled to the detection tool for storing data.

23. The apparatus of claim 18, wherein the oilfield tubular is a drill pipe, a tubing, a casing or a pipeline.

24. The apparatus of claim 18, further including a self contained power source for energizing the detection tool.

25. The apparatus of claim 18, wherein the waveform generating transmission portion transmits a waveform to the tubular.

26. The apparatus of claim 25, wherein the receiving portion receives an interacted waveform from the tubular.

27. A method for conducting an operation in an oil field tubular, comprising conveying a detection tool including a downhole memory into a wellbore on an electrically non-conductive mechanical connection member and along an interior of the tubular;

detecting a condition of the tubular by transmitting a waveform from the detection tool to a wall of the tubular and receiving an interacted waveform from the wall of the tubular, wherein the condition of the tubular is a stuckpoint or a freepoint; and storing the detected condition in the downhole memory.

28. The method of claim 27, further including inducing a stress in the tubular.

29. The method of claim 28, further including transmitting a second waveform from the detection tool to a wall of the stressed tubular and receiving a second interacted waveform from the wall of the tubular.

30. The method of claim 29, further including comparing the interacted waveform.

31. The method of claim 27, wherein the electrically non-conductive mechanical connection member is a slickline.

32. The method of claim 27, wherein the electrically non-conductive mechanical connection member is a coiled tubing.

33. The method of claim 27, further including communicating data regarding the condition to the surface of the wellbore.

34. The method of claim 27, further including communicating data regarding the condition through a telemetry module of the detection tool to a receiver proximate a surface of the wellbore.

35. The method of claim 27, wherein the detection tool includes a transmitter for transmitting the waveform and a receiver for receiving the interacted waveform.

36. The method of claim 27, wherein the oilfield tubular is at least one of a drill pipe, a tubing, a casing and a pipeline.

37. The method of claim 27, further including powering the detection tool with a power module.

38. The method of claim 27, further including memorizing data from the detection tool.

39. The method of claim 27, wherein detecting the condition comprises detecting a plurality of conditions over a length of the tubular.

40. The method of claim 39, further including memorizing the plurality of conditions.

41. An apparatus for conducting an operation in an oil field tubular, comprising:

an electrically non-conductive mechanical connection member configured to convey a detection tool, the detection tool comprising:

a power module;

a waveform transmitter/receiver including a waveform generating portion and a waveform receiving portion wherein the waveform generating portion is configured to send a waveform to interact with the oil field tubular and the waveform receiving portion is configured to receive an interacted waveform from the tubular;

a data processing module; and a memory module, configured to store data received by the waveform transmitter/receiver, wherein the data comprises at least one internal characteristic of a wall of the oil field tubular.

42. The apparatus of claim 41, wherein the data received by the waveform transmitter/receiver is a condition of a tubular in a borehole.

43. The apparatus of claim 42, wherein the condition is a stress in the tubular.

44. A method for detecting a condition of an oil field tubular, comprising:

conveying a detection tool along an interior of the tubular on a slickline;

transmitting a waveform from the detection tool to a wall of the tubular, the waveform interacting with the wall;

receiving an interacted waveform from the wall of the tubular; and communicating the condition of the tubular based upon the received interacted waveform to a user, wherein the condition is a tubular thickness.

45. A method for detecting a condition of an oil field tubular, comprising:

conveying a detection tool along an interior of the tubular on a slick line;

inducing a stress in the tubular;

transmitting a waveform from the detection tool to a wall of the tubular, the waveform interacting with the wall;

receiving an interacted waveform from the wall of the tubular; and communicating the condition of the tubular based upon the received interacted waveform to a user.

46. The method of claim 45, wherein the stress comprises a torsional stress.

47. The method of claim 45, wherein the stress comprises a tensile stress.

48. The method of claim 47, further including transmitting a second waveform from the detection tool to a wall of the stressed tubular and receiving a second interacted waveform from the wall of the tubular.

49. The method of claim 48, further including comparing the interacted waveform and the second interacted waveform.

* * * * *